US005735704A

United States Patent [19]

Anthony

[11] Patent Number: 5,735,704

[45] Date of Patent: Apr. 7, 1998

[54] SHROUD SEAL FOR SHROUDED ELECTRICAL CONNECTOR

[75] Inventor: John C. Anthony, Fairfield, Conn.

[73] Assignee: Hubbell Incorporated, Orange, Conn.

[21] Appl. No.: 442,840

[22] Filed: May 17, 1995

[51] Int. Cl.[6] ..... H01R 13/52

[52] U.S. Cl. ..... 439/271

[58] Field of Search ..... 439/271, 272, 439/277

[56] References Cited

U.S. PATENT DOCUMENTS

| | | | |
|---|---|---|---|
| 1,818,290 | 8/1931 | Wulle | 200/50 B |
| 3,513,436 | 5/1970 | Nodfelt | 339/90 |
| 4,056,298 | 11/1977 | Cooper et al. | 339/90 R |
| 4,456,320 | 6/1984 | Gallusser et al. | 439/271 |
| 4,553,000 | 11/1985 | Appleton | 200/50 B |
| 4,604,505 | 8/1986 | Henninger | 200/50 B |
| 4,695,259 | 9/1987 | Uchida | 439/271 |
| 4,801,277 | 1/1989 | Seilhan | 439/680 |

FOREIGN PATENT DOCUMENTS

| | | | |
|---|---|---|---|
| 404223075 | 8/1992 | Japan | 439/271 |
| 2128036 | 4/1984 | United Kingdom | 439/271 |

OTHER PUBLICATIONS

Killark Catalog, Electrical Construction Products, 1994, Section 1, p. 1 and Section 4, pp. 1–16.

Hubbell Catalog, Wiring Device & Systems, Kellems Wire Management Marine Wiring Products, 1995, Section M, pp. M1–M25.

*Primary Examiner*—Neil Abrams

*Assistant Examiner*—Eugene G. Byrd

*Attorney, Agent, or Firm*—Jerry M. Presson; David L. Tarnoff

[57] ABSTRACT

A shroud seal having an annular ring portion and an annular lip portion. The annular ring portion is installed on the shroud of an electrical connector such that the annular lip portion is axially compressed on the shroud by a mating shrouded electrical connector. The annular ring portion has a frustoconical inner sealing surface which is sized to be twisted from its original molded frustoconical form to a cylindrical form when installed around the shroud of the electrical connector. This twisting of the shroud seal produces a concentrated hoop stress in the seal at its points of contact with the shroud. The annular ring portion and the lip portion are compliant to allow for large axial tolerance variations between the mating electrical connectors, and provides for low insertion force between the mating electrical connector. In one embodiment, the electrical connector is in the form of a plug having a tubular portion or seal guard for encircling the shroud seal to protect the seal. In other embodiment, the electrical connector is in the form of an inlet having a mounting flange to mount the electrical connector to a wiring enclosure.

33 Claims, 4 Drawing Sheets

SHROUD SEAL FOR SHROUDED ELECTRICAL CONNECTOR

Field of the Invention

The present invention generally relates to a seal for use with a shrouded electrical connector. More specifically, this invention relates to an axially compliant seal which is installed on the shroud of an electrical connector for engaging the shroud of a mating electrical connector to create a weathertight seal therebetween.

BACKGROUND OF THE INVENTION

Shrouded electrical connectors are well known in the connector industry. Shrouded electrical connectors can be either a male electrical connector or a female electrical connector. A male electrical connector which is mounted to a wiring enclosure or a piece of equipment is called an inlet. A female electrical connector which is mounted to a wiring enclosure or a piece of equipment is called a receptacle or outlet.

Male electrical connectors include at least two, and typically at least three, prongs extending from a housing for joining with a complementary number of holes in a female connector. The male connectors usually include a cylindrical shroud extending from the base and encircling the prongs. The shroud is normally at least as long as the prongs and is often slightly longer than the prongs such that the prongs are slightly recessed in the shroud. The shroud primarily serves to protect the prongs from damage during shipping and handling of the connector. The mating female electrical connector or receptacle has a cylindrically shaped retainer housing which is received within the shroud of the male electrical connector or inlet and a shroud with a cylindrical recess encircling the retainer housing to receive the shroud of the male electrical connector or inlet therein.

Oftentimes, electrical connectors are used in adverse conditions, such as outdoors or even indoor areas in which water or other contaminants are being used. In these types of conditions, the contacts of the electrical connectors must be sealed from the environment. In particular, a hazard condition could occur if water is allowed to freely flow between the mated electrical connectors and engage energized contacts. Accordingly, the interfaces between mated electrical connectors must be sealed for use in these types of environments.

Many attempts have been made to seal the interfaces between mated electrical connectors to prevent the ingress of water or other contaminants therebetween. However, these prior attempts often result in an expensive sealing arrangement or an inadequate sealing arrangement which cannot be used with a shrouded electrical connector, especially of the locking type. Some examples of electrical connectors with sealing arrangements for sealing the interfaces between electrical connectors are disclosed in U.S. Pat. No. 3,513,436 to Nodfelt; U.S. Pat. No. 3,982,804 to Marechal; U.S. Pat. No. 4,056,298 to Cooper et al; and U.S. Pat. No. 4,553,000 to Appleton.

In view of the above, it is apparent that there exists a need for a shroud seal for a shrouded electrical connector to protect the electrical contacts of the mated electrical connectors from the environment. This invention addresses this need in the art, along with other needs and/or problems which will become apparent to those skilled in the art once given this disclosure.

SUMMARY OF THE INVENTION

One object of the present invention is to provide a shroud seal which is mounted on a cylindrical member or shroud of an electrical connector for engaging a shroud or cylindrical member of a mating electrical connector to seal the interface therebetween.

Another object of the present invention is to provide a shroud seal which is twisted from its original molded position so that a concentrated hoop stress is produced in the seal when installed on a shroud of an electrical connector.

Still another object of the present invention is to provide a shrouded electrical connector having a housing with a shroud seal which is protected from the environment when coupled to a mating electrical connector.

Yet another object of the present invention is to provide a shroud seal with a lip seal that is axially compressed by a shroud of a mating electrical connector.

The foregoing objects are basically attained by a shroud seal for installation on a shroud of an electrical connector, comprising an annular ring portion having an annular inner sealing surface forming an opening sized to frictionally engage the shroud of the electrical connector; and an annular lip portion integrally formed with the ring portion as a one-piece, unitary member of a compliant sealing material, the annular lip portion extending radially and axially relative to the inner sealing surface and having an annular lip sealing surface for engaging a portion of a mating shroud of a mating electrical connector.

Other objects, advantages, and salient features of the present invention will become apparent to those skilled in the art from the following detailed description, which taken in conjunction with the annexed drawings, discloses a preferred embodiment of the present invention.

BRIEF DESCRIPTION OF THE DRAWINGS

Referring now to the drawings which form part of this original disclosure.

DETAILED DESCRIPTION OF THE PREFERRED EMBODIMENT

Figure 1:
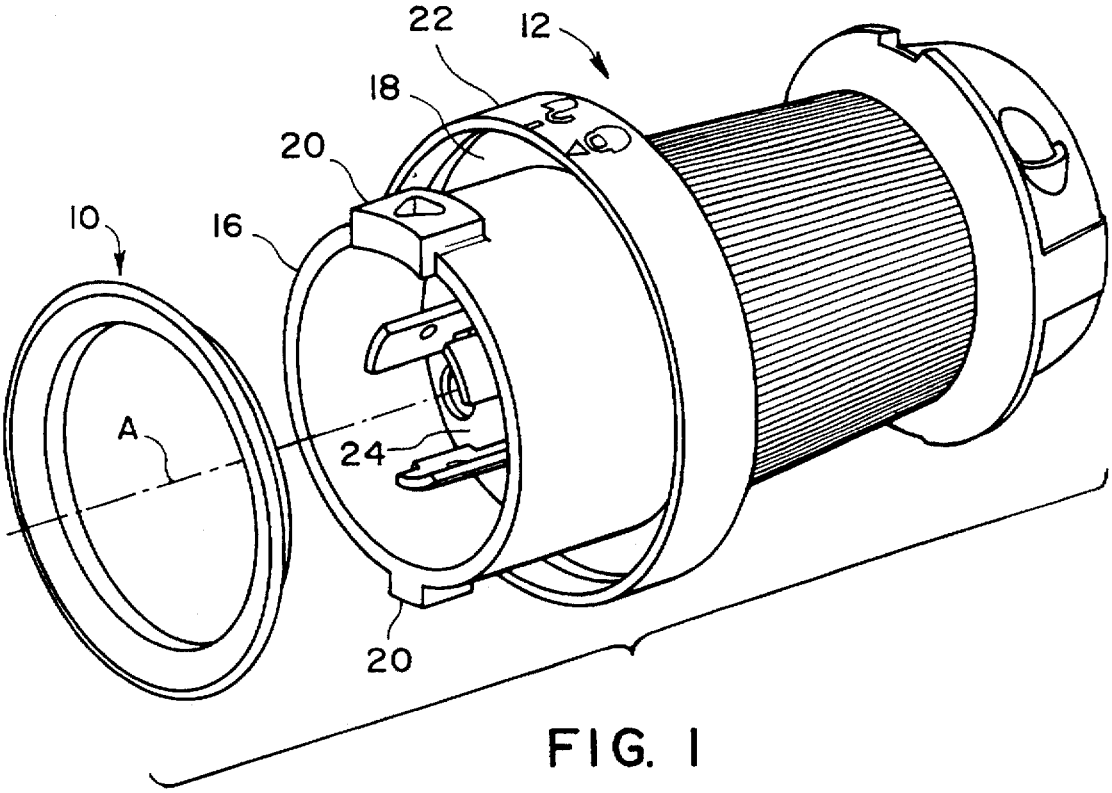
FIG. 1 is a partially exploded perspective view of a shroud seal in accordance with the present invention to together with a shrouded electrical connector in the form of a plug.
Figure 2:
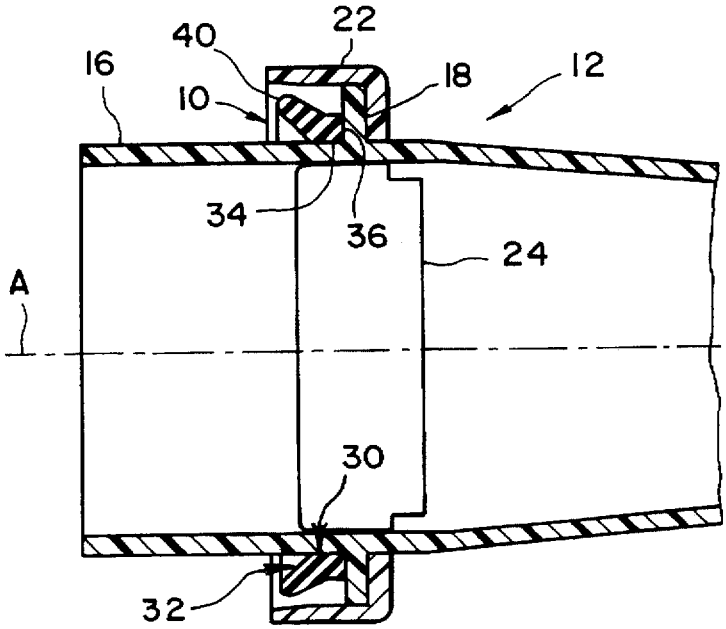
FIG. 2 is a longitudinal cross-sectional view of the shroud seal illustrated in FIG. 1 installed on the shrouded electrical connector which is schematically illustrated in cross-section.
Figure 3:
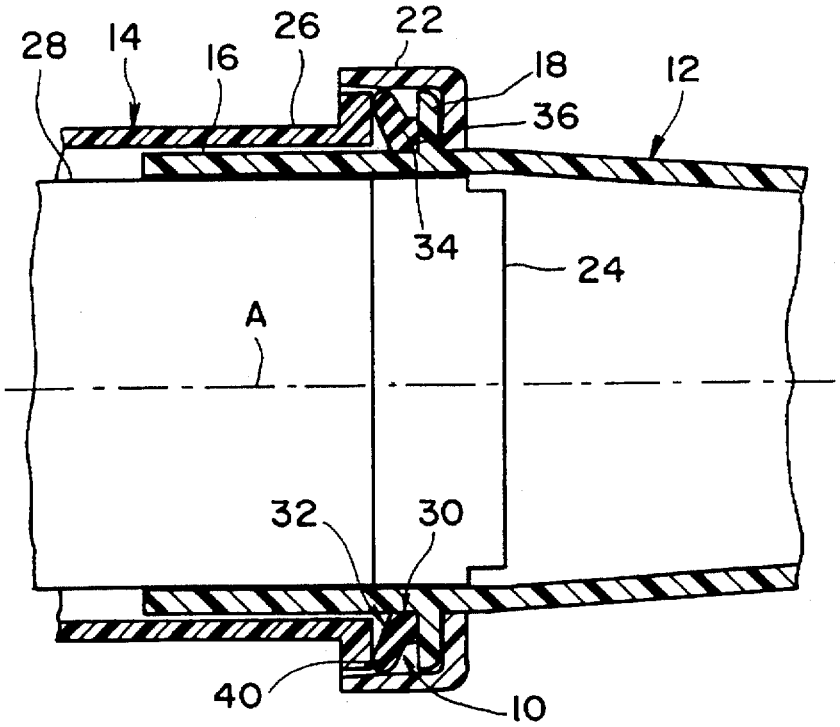
FIG. 3 is a longitudinal cross-sectional view of the shroud seal illustrated in FIGS. 1 and 2 installed on the shrouded electrical connector and compressed by a mating shrouded electrical connector, which are schematically illustrated in cross-section.

Referring initially to FIGS. 1–3, a shroud seal 10 in accordance with the present invention is illustrated for use in connection with a shrouded electrical connector 12 in the form of a plug. Shroud seal 10 is designed to provide a watertight seal between connector 12 and the mating connector 14. In particular, electrical connector 12 and mating electrical connector 14 are locking type connectors which are connected by first initial relative axial movement followed by subsequent rotational movement to lock the two connectors together. Seal 10 provides a watertight connection between electrical connectors 12 and 14 such that the contacts of electrical connectors 12 and 14 are protected from the environment.

More specifically, when electrical connectors 12 and 14 are coupled together, seal 10 is axially compressed during the initial relative axial insertion of mating connector 14 with electrical connector 12 to form a watertight interface therebetween. Seal 10 is then maintained under axial compression by relative rotation of the electrical connectors 12 and due to their respective polarizing members and slots.

Electrical connectors 12 and 14 are discussed in more detail in U.S. patent application Ser. No. 08/354,738, filed on Dec. 8, 1994 in the name of Patrick J. Tiberio, Jr. The disclosure of U.S. patent application Ser. No. 08/354,735 is hereby incorporated herein by reference. It will be apparent to those skilled in the art that shroud seal 10 can be used with other types of shrouded electrical connectors, including the pin type electrical connectors. Accordingly, the details of electrical connectors 12 and 14 will not be discussed or illustrated herein, except as they relate to shroud seal 10.

Basically, electrical connectors 12 and 14 are shrouded electrical connectors and preferably of the rotatable locking type. Electrical connector 12 has a shroud 16 with annular flange 18 positioned at one end and a pair of polarizing members or keys 20 at its other end. The housing of electrical connector 12 also has a seal guard 22 fixedly coupled thereto by a snap-fit and a contact retainer body 24 coupled thereto by screws. Seal guard 22 surrounds shroud seal 10 to protect shroud seal 10 from the environment.

As seen in FIG. 3, electrical connector 14 mates with electrical connector 12, and has a mating shroud 26 with polarizing slots (not shown) for mating with shroud 16 of electrical 12. Electrical connector 14 also has a contact retainer body 28 mounted within its housing in which its electrical contacts mate with the electrical contacts of contact retainer body 24.

Shroud seal 10 is an integrally molded, one piece, unitary member constructed out of a suitable compressible sealing material such as a resilient, compressible elastomeric material. For example, the sealing material can be silicone or neoprene. Preferably, shroud seal 10 has a durometer in the range of approximately 40 to approximately 50.

Figure 4:
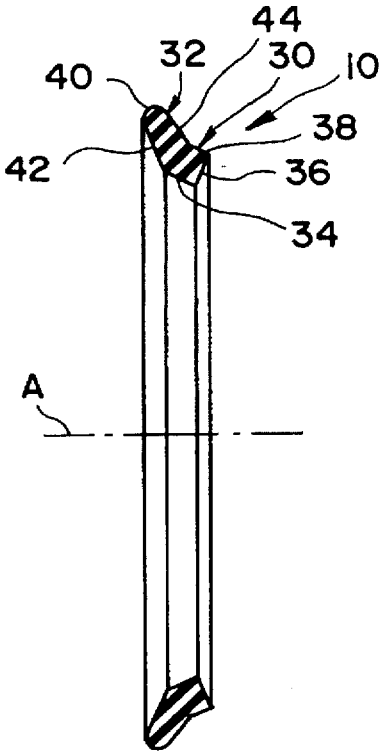
FIG. 4 is a slightly enlarged, longitudinal cross-sectional view of the shroud seal illustrated in FIGS. 1–3 prior to being installed on a shrouded electrical connector.
Figure 5:
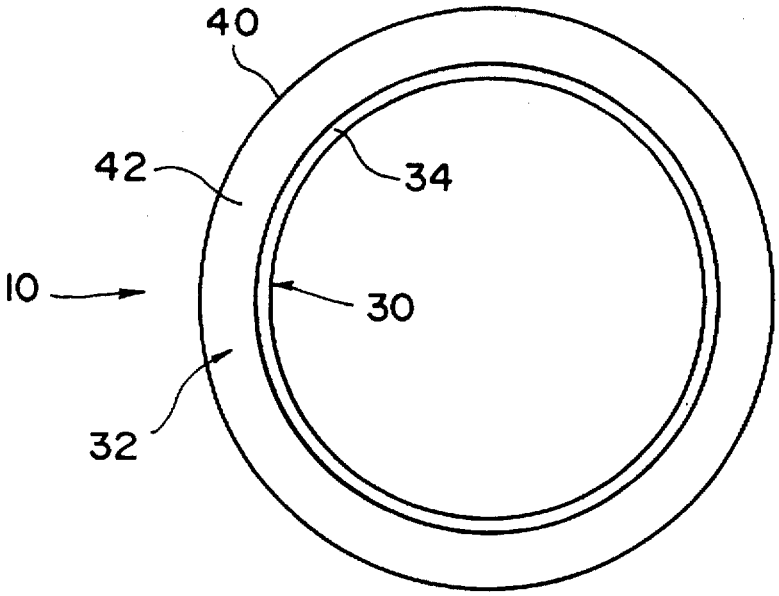
FIG. 5 is a front elevational view of the shroud seal illustrated in FIGS. 1–4 prior to being installed on a shrouded electrical connector.
Figure 6:
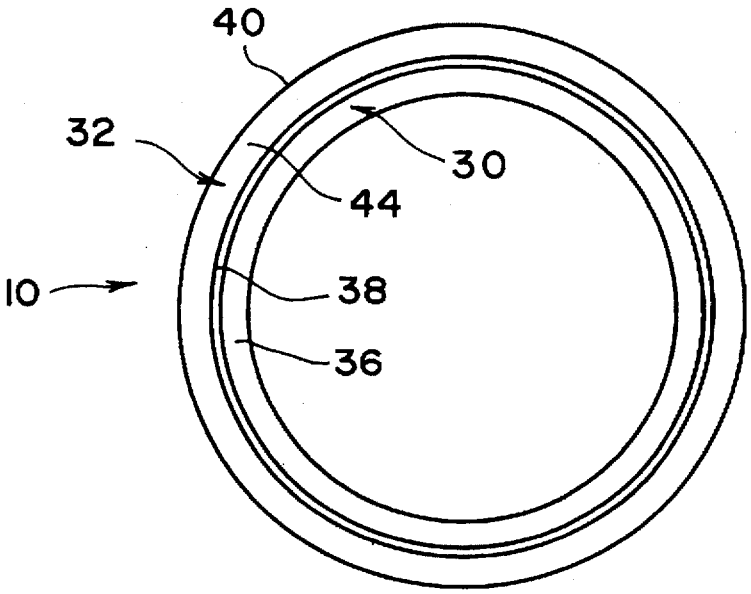
FIG. 6 is a rear elevational view of the shroud seal illustrated in FIGS. 1–5 prior to being installed on a shrouded electrical connector.

Referring now to FIGS. 4–6, shroud seal 10 includes an annular ring portion 30 and an annular lip portion 32 integrally formed with annular ring portion 30. Annular ring portion 30 is designed to be frictionally retained on shroud 16 of electrical connector 12 as discussed below, while annular lip portion 32 is designed to engage the edge of shroud 26 of mating electrical connector 14 as seen in FIG. 3.

More specifically, annular ring portion 30 provides the seal between the interface of shroud seal 10 and shroud 16 of electrical connector 12, while annular lip portion 32 seals the interface between shroud seal 10 and the edge of shroud 26 of mating electrical connector 14. Accordingly, these two sealing points prevent the ingress of water from entering between shrouds 16 and 26 and contacting the electrical contacts of electrical connectors 12 and 14.

Annular ring portion 30 includes an annular inner sealing surface 34, an annular end sealing surface 36 and an annular outer surface 38. Annular lip portion 32 is connected to annular ring portion 30 at the end opposite end sealing surface 36. Inner sealing surface 34 is designed to frictionally engage shroud 16, of electrical connector 12, while end sealing surface 36 is designed to engage annular flange 18 of electrical connector 12.

Seal guard 22 together with shroud 26 of mating connector 14 and shroud 16 of electrical connector 12 form a plastic labyrinth so that the seal is protected from the environment. Stated differently, only a small gap between the seal guard 22 and the shroud of mating electrical connector 14 is provided in which water or other contaminants can easily ingress to the shroud seal 10.

As best seen in FIG. 4, annular sealing inner surface 34 forms an annular frustoconical surface about the longitudinal center axis A of shroud seal 10 in its unstressed state. More specifically, the inner diameter of inner sealing surface 34 adjacent end sealing surface 36 has a smaller diameter than the inner diameter of inner sealing surface 34 adjacent annular lip portion 32. Preferably, the inner diameter of inner sealing surface 36 adjacent annular lip portion 32 is either substantially equal to the outer diameter of shroud 16 of electrical connector 12 or slightly smaller than the outer diameter of shroud 16 of electrical connector 12.

In any event, inner sealing surface 34 has a smaller diameter at annular end sealing surface 36 such that annular ring portion 30 is frictionally retained on shroud 16 of electrical connector 12. Moreover, due to the frustoconical shape of inner sealing surface 34, this elastic deformation of shroud seal 10 causes annular ring portion 30 to twist from its original molded form when installed around the plastic shroud 16 of electrical connector 12.

This twisting of shroud seal 10 provides sealing between shroud seal 10 and shroud 16 of electrical connector 12 by maintaining a concentrated hoop stress in shroud seal 10 where it contacts shroud 16. This ensures a watertight seal between the interface of inner sealing surface 34 and shroud 16 of electrical connector 12. Moreover, this twisting of shroud seal 10 rotates annular lip portion 32 radially inwardly so that the free end of annular lip portion 32 is designed to engage the free edge of shroud 26 of mating electrical connector 14 as discussed below.

Inner sealing surface 34 is preferably angled approximately 22° relative to the longitudinal center axis A of shroud seal 10 for providing the concentrated hoop stress in shroud seal 10. In other words, inner sealing surface 34 is angled relative to the longitudinal center axis A of shroud seal 10 in its unstressed state so that inner sealing surface 34 faces not only radially inwardly but also slightly axially in the direction of mating electrical connector 14 prior to being installed on shroud 16 of electrical connector 12.

End sealing surface 36 is a substantially planar surface which extends substantially perpendicular to inner sealing surface 34. In other words, when shroud seal 10 is in its unstressed state, end sealing surface 36 forms an angle of approximately 68° with the longitudinal center axis A of shroud seal 10. However, end sealing surface 36 extends perpendicular to the longitudinal center axis of shroud seal 10 when installed on shroud 16 of electrical connector 12, and thus faces axially. When shroud seal 10 is installed on shroud 16 of electrical connector 12, end sealing surface 36 is designed to engage annular flange 18 of electrical connector 12 as seen in FIGS. 2 and 3.

Accordingly, when electrical connector 12 and electrical connector 14 are coupled together, shroud seal 10 is axially compressed between the edge of shroud 26 of mating electrical connector 14 and annular flange 18 of electrical connector 12. In other words, end sealing surface 36 provides a seal between shroud seal 10 and annular flange 18 of electrical connector 12 when electrical connector 12 and electrical connector 14 are coupled together.

Outer surface 38 of parallel ring portion 30 extends parallel to inner sealing surface 34. In other words, outer sealing surface 38 forms a frustoconical surface which is parallel to the frustoconical of inner sealing surface 34 when shroud seal 10 is in its unstressed state. After shroud seal 10 is installed on shroud 16 of electrical connector 12, outer surface 38 is concentric with inner sealing surface 34 as well as being concentric with shroud 16 of electrical connector 12 as seen in FIG. 2.

As best seen in FIG. 4, annular lip portion 32 extends outwardly from annular ring portion 30 in both an axial direction and a radial direction. Annular lip portion 32 includes a curved annular lip sealing surface 40 at its free end and a pair of connecting surfaces 42 and 44. Curved lip surface 40 is designed to engage the free edge of shroud 26 of mating electrical connector 14 to seal the interface therebetween, when electrical connector 12 and mating electrical connector 14 are coupled together. Preferably, curved lip sealing surface 40 extends approximately 180° with approximately 120° of the curved lip sealing surface 32 engaging the edge of shroud 26 of electrical connector 14 to seal the interface therebetween.

Connecting surface 42 interconnects curved lip sealing surface 40 with inner sealing surface 34 and forms an angle of approximately 67° in its unstressed state with respect to the longitudinal center axis A of shroud seal 10. Annular connecting surface 42 faces both axially and radially towards mating electrical connector 14 with respect to the longitudinal center axis A of electrical connector 12.

Annular connecting surface 44 interconnects outer surface 38 of ring portion 30 with curved lip sealing surface 40 of annular lip portion 32 to form a contiguous outer surface of shroud seal 10. Outer annular connecting surface 44 forms an angle of approximately 50° in its unstressed state with respect to the longitudinal center axis of shroud seal 10. Accordingly, inner connecting surface 42 and outer connecting surface 44 converge towards each other as they approach curved lip sealing surface 40.

Installation and Operation of Shroud Seal 10

Shroud seal 10 is installed on shroud 16 of electrical connector 12 by stretching shroud seal 10 over polarizing members 20 and onto shroud 16 of electrical connector 12. Shroud seal 10 is moved axially along shroud 16 until end sealing surface 36 of shroud seal 10 engages annular flange 18 of electrical connector 12 as seen in FIG. 2. In this position, shroud seal 10 is twisted from it original molded position so that a concentrated hoop stress is produced in the seal where it contacts shroud 16. Moreover, in this twisted state, end sealing surface 36 extends substantially perpendicular to the outer surface of shroud 16 of electrical connector 12 and engages annular flange 18.

Now, mating electrical connector 14 can be coupled to electrical connector 12 by first aligning the polarizing members 20 of electrical connector 12 with the polarizing slots of mating electrical connector 14 so that shroud 26 of mating electrical connector 14 slides concentrically over shroud 16 of electrical connector 12. After complete axial insertion of mating electrical connector 14 relative to electrical connector 12, the edge of shroud 26 engages curved lip sealing surface 40 of shroud seal 10 so as to axially compress shroud seal 10 against annular flange 18 of electrical connector 12 s seen in FIG. 3.

Next, electrical connector 14 is rotated relative to electrical connector 12 to interlock electrical connectors 12 and 14 together. In this interlocked state, shroud seal 10 is maintained in its compressed position with curved lip sealing surface 40 engaging the end of shroud 26 of electrical connector 14 to prevent the ingress of water therebetween and end sealing surface 36 is compressed against annular flange 18 to prevent the ingress of water therebetween. Stated differently, the ingress of water or other contaminants is prevented by the sealing contact of inner sealing surface 34 engaging shroud 16, end sealing surface 36 engaging annular flange 18 and curved lip sealing surface 40 engaging shroud 26 of electrical connector 14.

Second Embodiment

Figure 7:
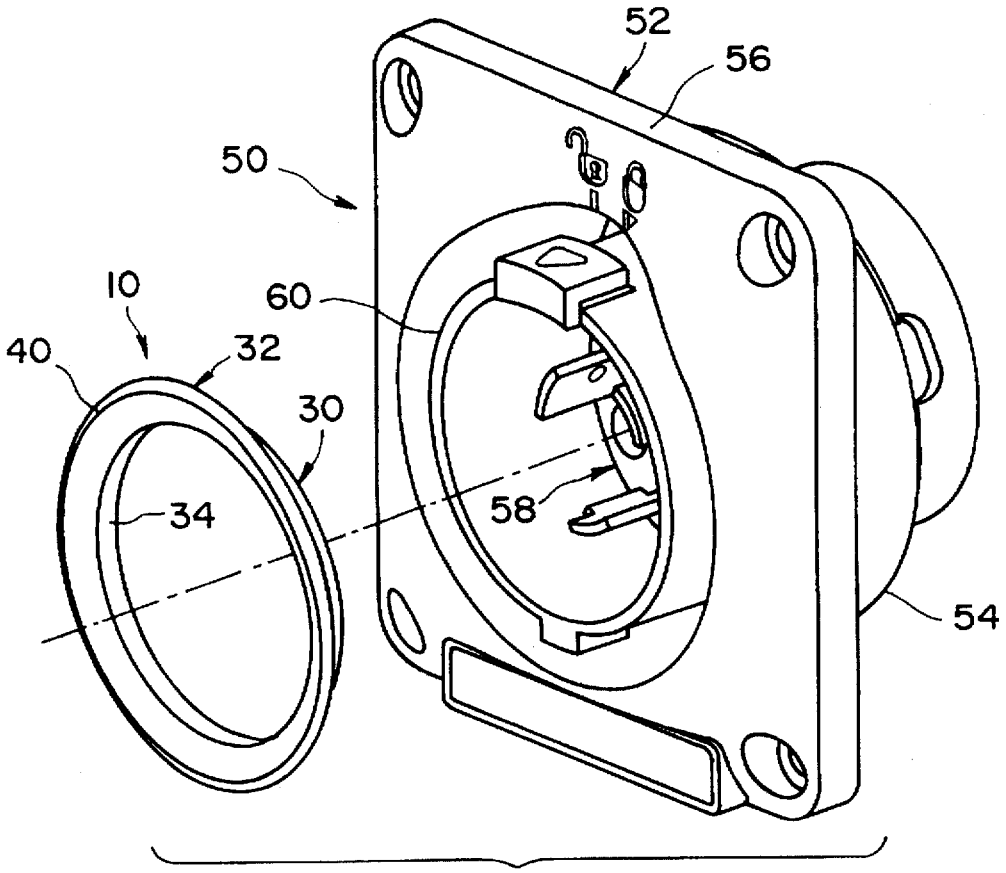
FIG. 7 is a partially exploded view of the shroud seal illustrated in FIGS. 1–6, but adapted to be installed on a mounted electrical connector or inlet.
Figure 8:
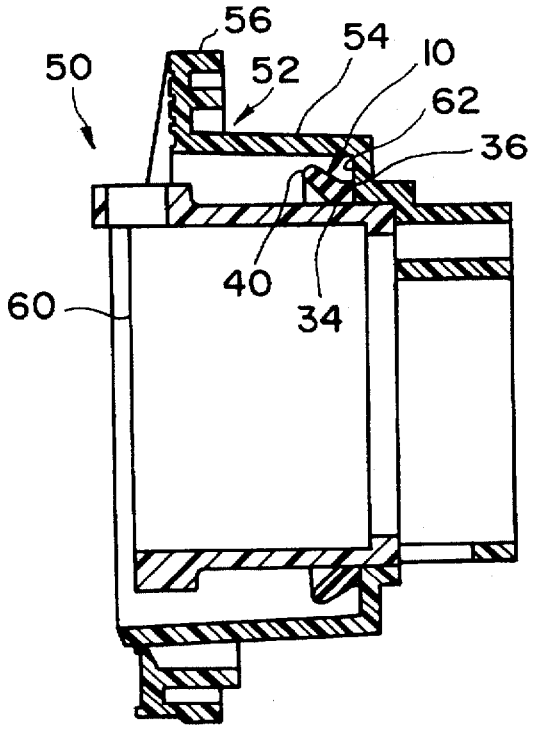
FIG. 8 is a longitudinal cross-sectional view of the shroud seal illustrated in FIGS. 1–7 and mounted on the electrical connector illustrated in FIG. 7.

Referring now to FIGS. 7 and 8, shroud seal 10 is illustrated in connection with a mounted electrical connector assembly 50 such as an inlet. While electrical connector assembly 50 is illustrated as an inlet which adapted to receive a mating female electrical connector such as electrical 14, it will be apparent to those skilled in the art that electrical connector assembly 50 could be a receptacle or female electrical connector which would be designed to receive a male electrical connector or plug therein.

Electrical connector assembly 50 includes an electrical connector housing 52 having a tubular body portion 54 with an annular mounting flange portion 56 integrally coupled thereto, an electrical connector 58 mounted in tubular body portion 54 and a shroud 60 coupled thereto via a press fit. Electrical connector assembly 50 is discussed in more detail in U.S. patent application Ser. No. 08/442,896 (RABG 32471) filed concurrently herewith in the name of John C. Anthony and entitled "Electrical Connector Housing", the disclosure of which is hereby incorporated herein by reference.

As in the first embodiment, shroud seal 10 is frictionally held on shroud 60 of electrical connector assembly 50 such that its inner sealing surface 34 is twisted from its original molded form when installed on shroud 60 and provides sealing to the plug shroud by maintaining a concentrated hoop stress in the seal where it comes into contact with the shroud.

As seen in FIG. 8, end sealing surface 36 of shroud seal 10 engages annular abutment surface 62 of tubular body portion 54 which extends radially between body portion 54 and shroud 60. As in the previous embodiment, tubular body portion 54 together with shroud 60 and the mating electrical connector 14 provides a plastic labyrinth so that shroud seal 10 is protected from the environment, especially a heavy stream of water directly contacting shroud seal 10.

While only two embodiments have been chosen to illustrate the shroud seal in combination with an electrical connector, it will be understood by those skilled in the art that various changes and modifications can be made herein without departing from the scope of the invention as defined in the appended claims.

What is claimed is:

1. A shroud seal for installation on a shroud of an electrical connector, comprising:

an annular ring portion extending about a longitudinal axis and having an annular inner sealing surface inclined relative to said longitudinal axis in its unstressed state forming an opening sized to frictionally engage said shroud of said electrical connector; and an annular lip portion integrally formed with said ring portion as a one-piece, unitary member of a compliant sealing material, said annular lip portion extending radially and axially relative to said inner sealing surface and having an annular lip sealing surface for engaging a portion of a mating shroud of a mating electrical connector and an annular connecting surface between said inner sealing surface and said lip sealing surface, said connecting surface being inclined relative to said longitudinal axis and to said inner sealing surface.

2. A shroud seal according to claim 1, wherein said inner sealing surface of said annular ring portion forms a frustoconical inner sealing surface in its unstressed state, and said connecting surface forms a frustoconical connecting surface, said frustoconical connecting surface being more steeply angled than said frustoconical inner sealing surface.

3. A shroud seal according to claim 2, wherein said frustoconical inner sealing surface has a first end with a first inner diameter adjacent said annular lip portion and a second end with a second inner diameter remote from said annular lip portion, with said first inner diameter being larger than said second inner diameter when in its unstressed state.

4. A shroud seal according to claim 3, wherein said annular ring portion further includes an annular end sealing surface extending outwardly relative to said inner sealing surface.

5. A shroud seal according to claim 4, wherein said annular end sealing surface extends substantially perpendicular to said inner sealing surface.

6. A shroud seal according to claim 5, wherein said annular end sealing surface is contiguous with said inner sealing surface.

7. A shroud seal according to claim 6, wherein said annular lip portion further includes an annular free end surface with a convexly curved profile, and an outer frustoconical surface, said annular lip sealing surface being formed at least partially by said free end surface.

8. A shroud seal according to claim 1, wherein said sealing material is formed of an elastomeric material.

9. A shroud seal according to claim 8, wherein said elastomeric material forming said sealing material is neoprene.

10. A shrouded electrical connector, comprising:

a housing having an electrical contact cavity, a tubular shroud with an outer surface, and an outwardly extending flange formed adjacent said shroud;

a set of electrical contacts mounted within said cavity of said housing; and a shroud seal coupled to said outer surface of said shroud for engaging a portion of a mating electrical connector, said shroud seal including an annular ring portion extending about a longitudinal axis and having an annular inner sealing surface inclined relative to said longitudinal axis in its unstressed state forming an opening sized to frictionally engage said shroud of said electrical connector; and an annular lip portion integrally formed with said ring portion as a one-piece, unitary member of a compliant sealing material, said annular lip portion extending radially and axially relative to said inner sealing surface and having an annular lip sealing surface for engaging a portion of a mating shroud of a mating electrical connector and an annular connecting surface between said inner sealing surface and said lip sealing surface, said connecting surface.

11. A shrouded electrical connector according to claim 10, wherein said housing further includes an outer tubular portion concentric with said shroud and encircling said shroud seal.

12. A shrouded electrical connector according to claim 11, wherein said annular lip portion of said shroud seal is normally spaced inwardly from said outer tubular portion prior to deformation by said mating electrical connector.

13. A shrouded electrical connector according to claim 10, wherein said inner sealing surface of said annular ring portion forms a frustoconical inner sealing surface in its unstressed state, said connecting surface forms a frustoconical connecting surface, said frustoconical connecting surface being more steeply angled than said frustoconical inner sealing surface.

14. A shrouded electrical connector according to claim 13, wherein said frustoconical inner sealing surface has a first end with a first inner diameter adjacent said annular lip portion and a second end with a second inner diameter remote from said annular lip portion, with said first inner diameter being larger than said second inner diameter when in its unstressed state.

15. A shrouded electrical connector according to claim 14, wherein said annular ring portion further includes an annular end sealing surface extending outwardly relative to said inner sealing surface.

16. A shrouded electrical connector according to claim 15, wherein said annular end sealing surface extends substantially perpendicular to said inner sealing surface.

17. A shrouded electrical connector according to claim 16, wherein said annular end sealing surface is contiguous with said inner sealing surface.

18. A shrouded electrical connector according to claim 17, wherein said annular lip portion further includes an annular free end surface with a convexly curved profile, and an outer frustoconical surface, said annular lip sealing surface being formed at least partially by said free end surface of said annular lip portion.

19. A shrouded electrical connector according to claim 18, wherein said sealing material is formed of an elastomeric material.

20. A shrouded electrical connector according to claim 19, wherein said housing further includes an outer tubular portion concentric with said shroud and encircling said shroud seal.

21. A shrouded electrical connector according to claim 20, wherein said annular lip portion of said shroud seal is normally spaced inwardly from said outer tubular portion prior to deformation by said mating electrical connector.

22. A shrouded electrical connector according to claim 21, wherein said outer tubular portion is formed by a seal guard coupled to an exterior portion of said housing.

23. A shrouded electrical connector according to claim 22, wherein said housing further includes mounting flange for releasably coupling said housing to an enclosure.

24. A shroud seal for installation on a shroud of an electrical connector, comprising:

an annular ring portion having an annular inner sealing surface forming an opening sized to frictionally engage said shroud of said electrical connector; and an annular lip portion integrally formed with said ring portion as a one-piece, unitary member of a compliant elastomeric material, said annular lip portion extending radially, axially and outwardly relative to said inner sealing surface and having an annular lip sealing surface for engaging a portion of a mating shroud of a mating electrical connector, said annular lip portion including an inner frustoconical surface, an annular free end surface with a substantially convexly curved profile, and an outer frustoconical surface, said first annular end sealing surface being formed at least partially by said annular free end surface.

25. A shroud seal according to claim 24, wherein said inner sealing surface of said annular ring portion is angled relative to its longitudinal axis to form a frustoconical inner sealing surface in its unstressed state, said frustoconical inner sealing surface has a first end with a first inner diameter adjacent said annular lip portion and a second end with a second inner diameter remote from said annular lip portion, with said first inner diameter being larger than said second inner diameter when in its unstressed state.

26. A shroud seal according to claim 24, wherein said annular ring portion further includes an annular end sealing surface extending outwardly and substantially perpendicular relative to said inner sealing surface.

27. A shroud seal according to claim 24, wherein said annular free end of said annular lip portion is positioned between and substantially contiguous with said inner and outer frustoconical surfaces of said annular lip portion.

28. A shrouded electrical connector, comprising:

a housing having an electrical contact cavity, a tubular shroud with an outer surface, and an outwardly extending flange formed adjacent said shroud;

a set of electrical contacts mounted within said cavity of said housing; and a shroud seal coupled to said outer surface of said shroud for engaging a portion of a mating electrical connector, said shroud seal including an annular ring portion having an annular inner sealing surface forming an opening sized to frictionally engage said shroud of said electrical connector; and an annular lip portion integrally formed with said ring portion as a one-piece, unitary member of a compliant elastomeric material, said annular lip portion extending radially, axially and outwardly relative to said inner sealing surface and having an annular lip sealing surface for engaging a portion of a mating shroud of a mating electrical connector, said annular lip portion including an inner frustoconical surface, an annular free end surface with a substantially convexly curved profile, and an outer frustoconical surface, said annular lip sealing surface being formed at least partially by said annular free end surface of said annular lip portion.

29. A shrouded electrical connector according to claim 28, wherein said housing further includes an outer tubular portion concentric with said shroud and encircling said shroud seal.

30. A shrouded electrical connector according to claim 29, wherein said annular lip portion of said shroud seal is normally spaced inwardly from said outer tubular portion prior to deformation by said mating electrical connector.

31. A shrouded electrical connector according to claim 30, wherein said tubular shroud includes at least one polarizing member.

32. A shrouded electrical connector according to claim 31, wherein said inner sealing surface of said annular ring portion is angled relative to its longitudinal axis to form a frustoconical inner sealing surface in its unstressed state.

33. A shrouded electrical connector according to claim 32, wherein said annular ring portion further includes an annular end sealing surface extending outwardly and substantially perpendicular relative to said inner sealing surface.

* * * * *